United States Patent [19]

Moser et al.

[11] Patent Number: 4,535,697

[45] Date of Patent: Aug. 20, 1985

[54] CARTRIDGE CASE AND APPARATUS FOR PRODUCING THE SAME

[75] Inventors: Franz Moser, Fehraltorf; Max Steinemann, Regensberg, both of Switzerland

[73] Assignee: Werkzeugmaschinenfabrik Oerlikon-Bührle AG, Zürich, Switzerland

[21] Appl. No.: 490,532

[22] Filed: May 2, 1983

[30] Foreign Application Priority Data

Jun. 8, 1982 [CH] Switzerland ..... 3515/82

[51] Int. Cl.[3] ..... F42B 5/28

[52] U.S. Cl. ..... 102/468; 102/464

[58] Field of Search ..... 102/464–472, 102/432, 430

[56] References Cited

U.S. PATENT DOCUMENTS

| | | | |
|---|---|---|---|
| 2,402,068 | 6/1946 | Meador | 102/464 |
| 3,034,433 | 5/1962 | Gronn | 102/464 |
| 3,485,170 | 12/1969 | Scanlon | 102/432 |
| 3,749,023 | 7/1973 | Kawaguchi et al. | 102/466 |
| 3,977,326 | 8/1976 | Anderson et al. | 102/467 |
| 4,041,868 | 8/1977 | Rayle et al. | 102/468 |

FOREIGN PATENT DOCUMENTS

| | | | |
|---|---|---|---|
| 119753 | 4/1901 | Fed. Rep. of Germany . | |
| 700255 | 12/1940 | Fed. Rep. of Germany . | |
| 1113880 | 9/1961 | Fed. Rep. of Germany . | |
| Ad.2762 | 2/1911 | United Kingdom . | |
| 732633 | 6/1955 | United Kingdom | 102/464 |
| 1314524 | 4/1973 | United Kingdom . | |

*Primary Examiner*—Harold J. Tudor

*Attorney, Agent, or Firm*—Werner W. Kleeman

[57] ABSTRACT

When cartridges are introduced into a weapon there exists the danger that the conical shoulder of the cartridge case or sleeve will be deformed to an undesired degree. To avoid such disadvantage the wall of the conical shoulder is constructed to be thicker than the wall of the case or sleeve body of the cartridge case. For producing such a cartridge case an extruding mandrel is used which contains a recess at the region of the conical shoulder in order to generate a region of increased wall thickness in the wall of the cartridge case or sleeve.

1 Claim, 2 Drawing Figures

CARTRIDGE CASE AND APPARATUS FOR PRODUCING THE SAME

BACKGROUND OF THE INVENTION

The present invention relates to a new and improved construction of cartridge case or sleeve and to apparatus for producing the same.

In its more particular aspects, the present invention relates to a new and improved cartridge case comprising a base or floor of the case, a case body, a conical shoulder, and a case neck, the wall thickness of the case body continuously decreasing from the case base towards the conical shoulder.

In a cartridge case as known, for example, from Swiss Pat. No. 503,966, the wall thickness of the conical shoulder is the same as or smaller than the wall thickness of the case body. Upon feeding the cartridge containing such a cartridge case to a firing weapon the highest stress or loading occurs at the conical shoulder, whereby the shoulder becomes upset to an undesired extent.

SUMMARY OF THE INVENTION

Therefore, with the foregoing in mind it is a primary object of the present invention to provide a new and improved cartridge case which resists the forces occurring during infeed of the cartridge to the weapon, so that there does not occur any undesired upsetting of the conical shoulder.

Another important object of the present invention is directed to the provision of a new and improved apparatus for producing a cartridge case having a conical shoulder which resists the forces occurring when the cartridge is infed to a firing weapon.

Now in order to implement these and still further objects of the invention, which will become more readily apparent as the description proceeds, the cartridge case of the present development is manifested by the features that, the wall of the conical shoulder is thicker than the wall of the case body at the thinnest location thereof.

The apparatus of the present development is manifested by the features that an extruding mandrel is provided which includes a recess or groove arranged at the region of the conical shoulder in order to produce a region of increased wall thickness in the wall of the cartridge case.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
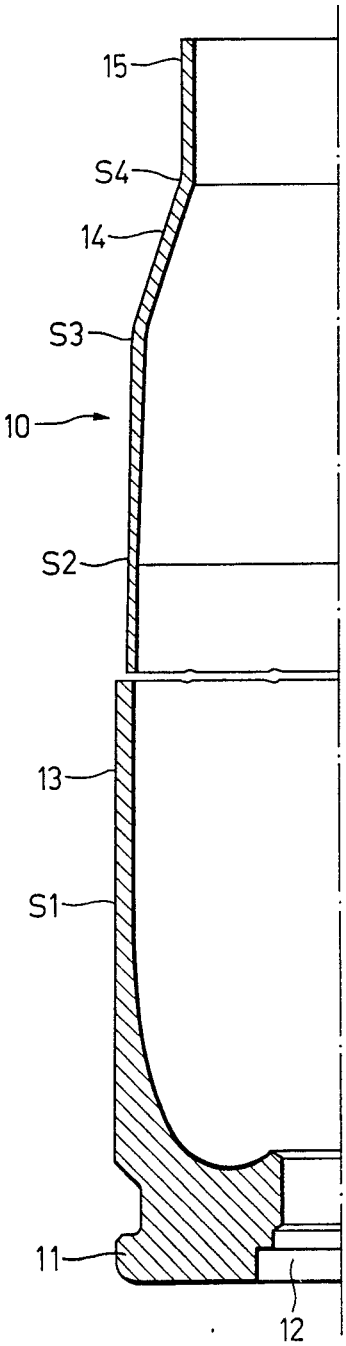
FIG. 1 is a longitudinal sectional view through a cartridge case constructed according to the invention.

Describing now the drawings, it is to be understood that only enough of the construction of the cartridge case and of the apparatus for producing the same has been shown as needed for those skilled in the art to readily understand the underlying principles and concepts of the present development, while simplifying the showing of the drawings. Turning attention now specifically to FIG. 1 there has been illustrated a longitudinal section of a cartridge case or sleeve 10 which may be formed, for instance, from steel and comprises:

(a) a base or floor 11 of the case or casing 10 having a bore 12 to receive a priming or firing cap (not shown), (b) a case body 13 which is preferably of slightly conical design as, for example, 2.5%, i.e. with an angle of 0°42′58″, (c) a conical shoulder 14 having a more pronounced tapered or conical design like, for example, 18°30′, and (d) a case neck 15 which preferably possesses a substantially cylindrical design or construction.

The wall of the case body 13 continuously decreases in thickness from the base 11 of the case towards the conical shoulder 14 up to the location S2. Thereafter, the wall of the case body 13 continuously again increases up to the location S3. The wall of the conical shoulder 14 then either becomes continuously thinner from the case body 13 towards the case neck 15 or has the same thickness throughout.

In the cartridge case 10 according to the invention the wall of the conical shoulder 14 is thicker than the wall of the case body 13 at the location S2. The wall thickness of the case body 13, in accordance with FIG. 1, continuously decreases from the value S1 to the value S2 and, then, continuously increases to the value S3. The wall of the conical shoulder 14 has the same wall thickness throughout and possesses the value S3. The case neck 15 has the same wall thickness of a value S4 throughout.

The greater thickness of the wall of the conical shoulder 14 is necessary since this region of the cartridge case 10 is more markedly loaded or stressed, particularly by acceleration or, deceleration forces, as the case may be, when the cartridge is infed to the weapon.

Figure 2:
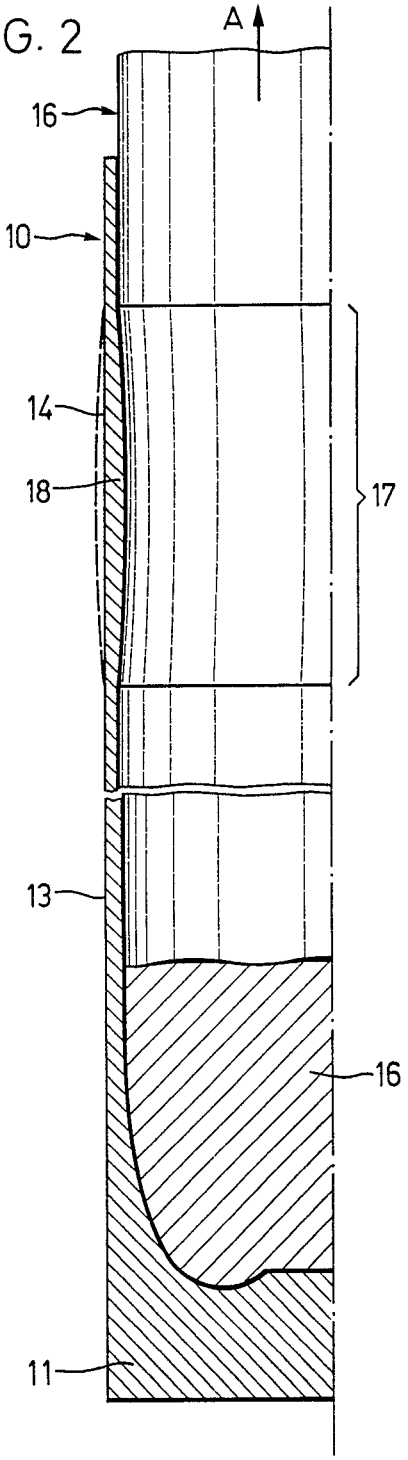
FIG. 2 is a longitudinal section through a cartridge case and an extruding mandrel of the apparatus of the invention, the parts being shown in an intermediate state of the production or fabrication process.

In accordance with FIG. 2 an extruding or extrusion mandrel 16 is used in the apparatus according to the invention for producing the cartridge case 10 as described hereinbefore. The extruding mandrel 16 contains a circumferential recess or groove 17 at the region of the conical shoulder 14 of the cartridge case 10 to be produced. The circumferential recess or groove 17 is structured such that during extruding of the cartridge case 10 a region 18 of increased thickness is formed in the cartridge case wall. When the extruding mandrel 16 is withdrawn from the cartridge case 10 in the direction of the arrow A this region 18 of greater thickness is radially outwardly pressed as indicated in FIG. 2 by a broken line. Due to the recess or groove 17 at the extruding mandrel 16 the stripping-off of the cartridge case 10 from the extruding mandrel 16 becomes more difficult, but without there being required any special stripping-off or stripper apparatus. In this way the necessary increased wall thickness region 18 is obtained in the desired region and to the desired extent.

When the case neck 15 is shaped or its diameter correspondingly reduced, i.e. when the cartridge case 10 is given the final shape, the wall becomes thicker at the desired location by the desired amount, and thus, the conical shoulder 14 is increased in wall thickness. By increasing the wall thickness of the conical shoulder 14 by the desired amount the upset conditions with respect to the cartridge case 10 are advantageously influenced when the same is infed to the cartridge chamber and are adapted to the prevailing requirements.

While there are shown and described present preferred embodiments of the invention, it is to be distinctly understood that the invention is not limited thereto, but may be otherwise variously embodied and practiced within the scope of the following claims.

We claim:

1. An extruded steel cartridge case integrally formed from a one-piece blank, comprising:

a case base;

a case body having a wall thickness;

a conical shoulder having a wall having the same wall thickness throughout;

the wall thickness of said case body continuously decreasing from said case base to a predetermined intermediate location and continuously increasing from said predetermined intermediate location to a predetermined location in the direction towards said conical shoulder;

said predetermined intermediate location being closer to said conical shoulder than said case base;

said wall of said conical shoulder having a greater wall thickness than said wall thickness of said case body at said predetermined intermediate location thereof; and a case neck following and adjacent to the conical shoulder having a wall which is thinner than said wall of said conical shoulder.

* * * * *